US009339681B1

(12) United States Patent
Nalley

(10) Patent No.: US 9,339,681 B1
(45) Date of Patent: May 17, 2016

(54) WEIGHT PLATE WITH CENTER POST LOCKING CARTRIDGE AND LOCKING FORK

(71) Applicant: Core Health & Fitness, LLC, Vancouver, WA (US)

(72) Inventor: Mark Nalley, Murrietta, CA (US)

(73) Assignee: Core Health & Fitness, LLC, Vancouver, WA (US)

( * ) Notice: Subject to any disclaimer, the term of this patent is extended or adjusted under 35 U.S.C. 154(b) by 0 days.

(21) Appl. No.: 14/558,271

(22) Filed: Dec. 2, 2014

(51) Int. Cl.
*A63B 21/06* (2006.01)
*A63B 21/072* (2006.01)
*A63B 21/075* (2006.01)

(52) U.S. Cl.
CPC ..... *A63B 21/0728* (2013.01); *A63B 21/075* (2013.01)

(58) Field of Classification Search
USPC ..... 482/1–148
See application file for complete search history.

(56) References Cited

U.S. PATENT DOCUMENTS 7,435,206 B1 * 10/2008 Nalley ..... A63B 21/0628 482/106
7,588,520 B2 * 9/2009 Nalley ..... A63B 21/0728 482/103
7,608,021 B1 * 10/2009 Nalley ..... A63B 21/0628 482/98
8,047,970 B2 * 11/2011 Nalley ..... A63B 21/0628 482/100
8,075,458 B2 * 12/2011 Nalley ..... A63B 21/0615 482/94
8,708,870 B2 * 4/2014 Nalley ..... A63B 21/063 482/98
2010/0285933 A1 * 11/2010 Nalley ..... A63B 21/0615 482/94
2015/0251041 A1 * 9/2015 Smith ..... A63B 24/0087 482/98
2015/0251042 A1 * 9/2015 Smith ..... A63B 24/0087 482/98

* cited by examiner

*Primary Examiner* — Stephen Crow
(74) *Attorney, Agent, or Firm* — Brown IP Law LC; Kerry W. Brown

(57) ABSTRACT

A weight plate for physical fitness weight lifting equipment so that the weight plate may be coupled to other weight plates and lifted in a stack. The weight plate includes a pivotal switch arm having a first end at which to receive a pushing force to cause the switch arm to rotate and an opposite end at which a fork is carried. A post runs through a center bore hole of the weight plate. The weight plate also includes an intermediate channel and a locking cavity that are aligned with one another at opposite sides of the bore hole. When the pivotal switch arm is rotated to a locked position, the fork is rotated through the intermediate channel, into surrounding engagement with the center post, and completely through the bore hole for receipt by the locking cavity by which the weight plate is reliably coupled to the post.

11 Claims, 6 Drawing Sheets

WEIGHT PLATE WITH CENTER POST LOCKING CARTRIDGE AND LOCKING FORK

BACKGROUND OF THE INVENTION

1. Field of the Invention

This invention relates to a weight plate adapted to be selectively coupled to the center post of physical fitness weight-lifting equipment so that one or more weight plates may be lifted by the center post during a body-building exercise. The weight plate includes a locking cartridge having a fork that is carried by a rotatable toggle lever switch arm so that a pair of fingers of the fork are moved (i.e., rotated) from an unlocked position to a locked position for receipt by a finger locking cavity formed in the weight plate body, whereby the fork is reliably coupled to the center post.

2. Background Art

My U.S. Pat. No. 7,608,021 issued Oct. 27, 2009 discloses a weight plate that is associated with weight lifting equipment by which the weight plate or a stack of weight plates can be lifted during a body building exercise. This weight plate includes a plate body and a locking cartridge connected to the plate body. The displacement of a locking pin through the weight plate body is controlled by a manually-accessible toggle lever arm that is located within the locking cartridge and coupled to the locking pin. When the toggle lever arm is rotated to an on or locked position, the locking pin is correspondingly caused to slide in a first direction through the plate body to engage a connection union mounted in an adjacent weight plate. When the toggle lever arm is rotated to an off or unlocked position, the locking pin is caused to slide in an opposite direction through the plate body to be disengaged from the connection union.

My later U.S. Pat. No. 8,708,870 issued Apr. 29, 2014 takes advantage of my earlier patented weight plate and the locking cartridge thereof so that the weight plate can be selectively and releasably attached to a conventional center post that is associated with weightlifting equipment to enable the weight plate to be lifted with a stack of similarly-attached weight plates during a body building exercise. In particular, the aforementioned advantage is achieved by means of the locking cartridge having a locking fork that is moved through the locking cartridge and coupled to the center post while avoiding the use of a separate locking pin that slides through the locking cartridge to engage with or disengage from a connecting union as a toggle lever arm is rotated.

Despite the advantages provided by my recently-patented weight plate and the locking cartridge thereof, the locking fork of the locking cartridge may become inadvertently uncoupled from the center post as the heavy weight plate is lifted with the stack of weight plates during the body building exercise. Accordingly, what is now desirable is a means by which the locking fork will remain reliably coupled to the center post to prevent an accidental detachment of the weight plate from the center post throughout the exercise.

SUMMARY OF THE INVENTION

In general terms, a weight plate is disclosed that is useful in certain physical fitness weight lifting equipment in which one or a stack of weight plates is lifted during a body building exercise. The weight plate includes a plate body having at least a central bore hole formed therethrough. The central bore hole through the plate body is sized to receive a conventional center post from the weight lifting equipment. A locking cartridge is connected to the weight plate body.

The locking cartridge has a housing that is received within a cavity formed in the weight plate body. A manually-operated toggle lever switch arm is connected to a pivot and adapted to rotate within the housing between locked and unlocked positions. One end of the toggle lever switch arm is connected to a switch control knob located outside the housing to which a rotational force is applied by a user to cause a corresponding rotation of the switch arm located inside the housing to one of the locked or unlocked positions. A curved fork or catch having a pair of elongated fingers that are spaced from one another is connected to the opposite end of the toggle lever switch arm. The fork is moved along an intermediate channel that extends through the weight plate body between the housing of the locking cartridge and one side of the center bore hole of the weight plate. A finger locking cavity is formed within the weight plate body so as to lie opposite and communicate with the intermediate channel at the opposite side of the center bore hole.

According to a preferred embodiment of this invention, when the switch control knob is rotated in a first direction, the toggle lever switch arm is correspondingly rotated to the locked position. In this case, the fork carried by the switch arm is moved through the intermediate channel of the weight plate body and into locking engagement with the center post of the weightlifting equipment at the center bore hole, whereby the weight plate is coupled to and lifted by the center post along with a stack of similarly coupled weight plates during a lifting exercise. Each of the pair of fingers of the fork is sufficiently long so as to extend completely through the center bore hole and into the finger locking cavity lying opposite the intermediate channel. With the fingers of the fork received within the finger locking cavity, a structural reinforcement is advantageously provided to help prevent the inadvertent detachment of the fork from its locking engagement with the center post as the weight plate is lifted in response to an upward lifting force applied to the center post. Therefore, the weight plate is unlikely to be uncoupled from the center post throughout the exercise.

When the switch control knob is rotated in an opposite direction, the toggle lever switch arm is correspondingly rotated to the unlocked position. In this case, the elongated fingers of the the fork carried by the switch arm are moved out of the finger locking cavity and through the intermediate channel so as to be disengaged from their former locking engagement with the center post, whereby the weight plate is uncoupled from the center post to be removed from the stack.

DESCRIPTION OF THE PREFERRED EMBODIMENT

Figure 1:
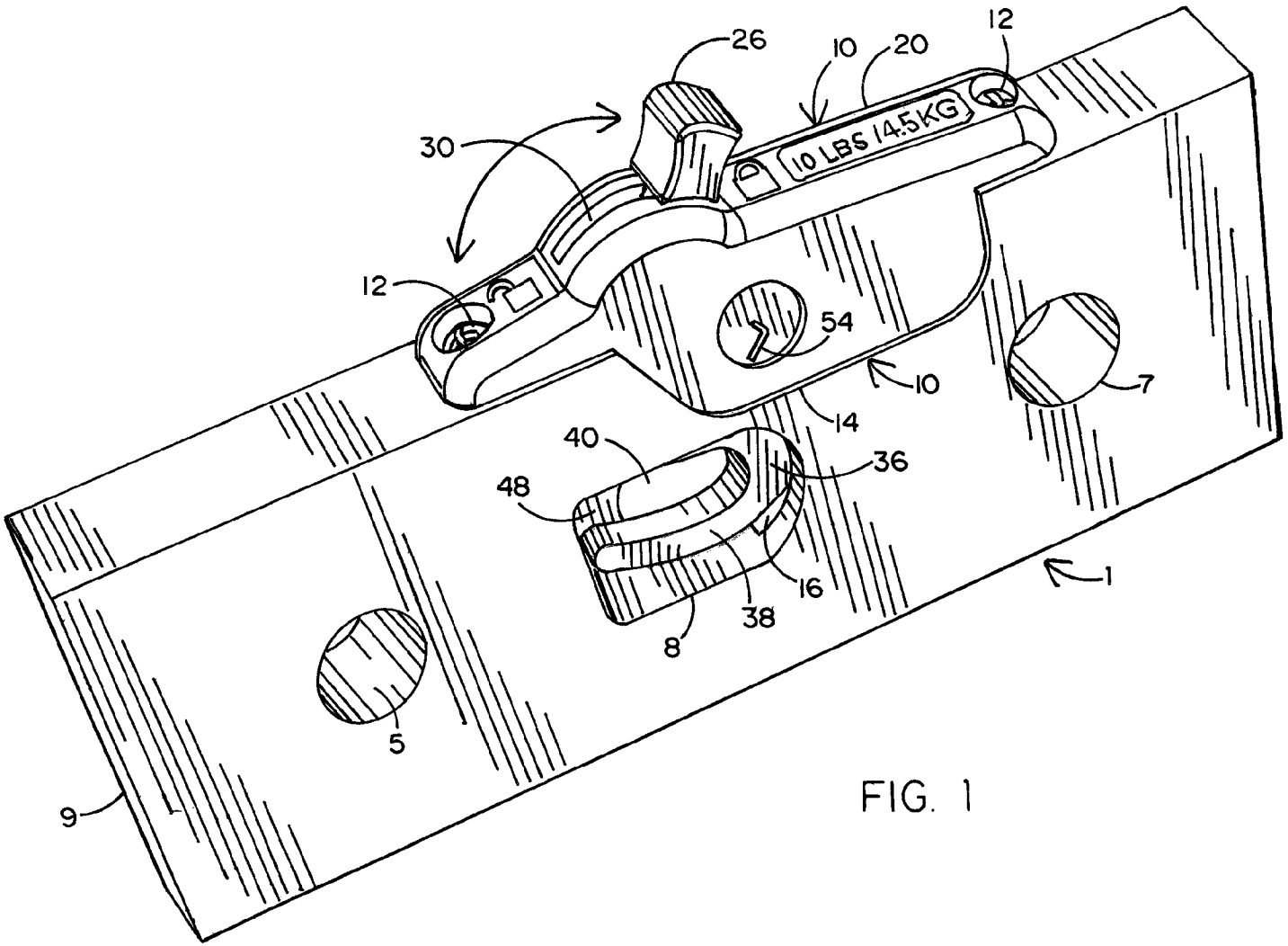
FIG. 1 is a bottom perspective view of a weight plate having a locking cartridge with a rotatable toggle lever switch arm by which a fork that is carried by the switch arm is moved through the weight plate between locked and unlocked positions with respect to a center bore hole formed in the weight plate.
Figure 2:
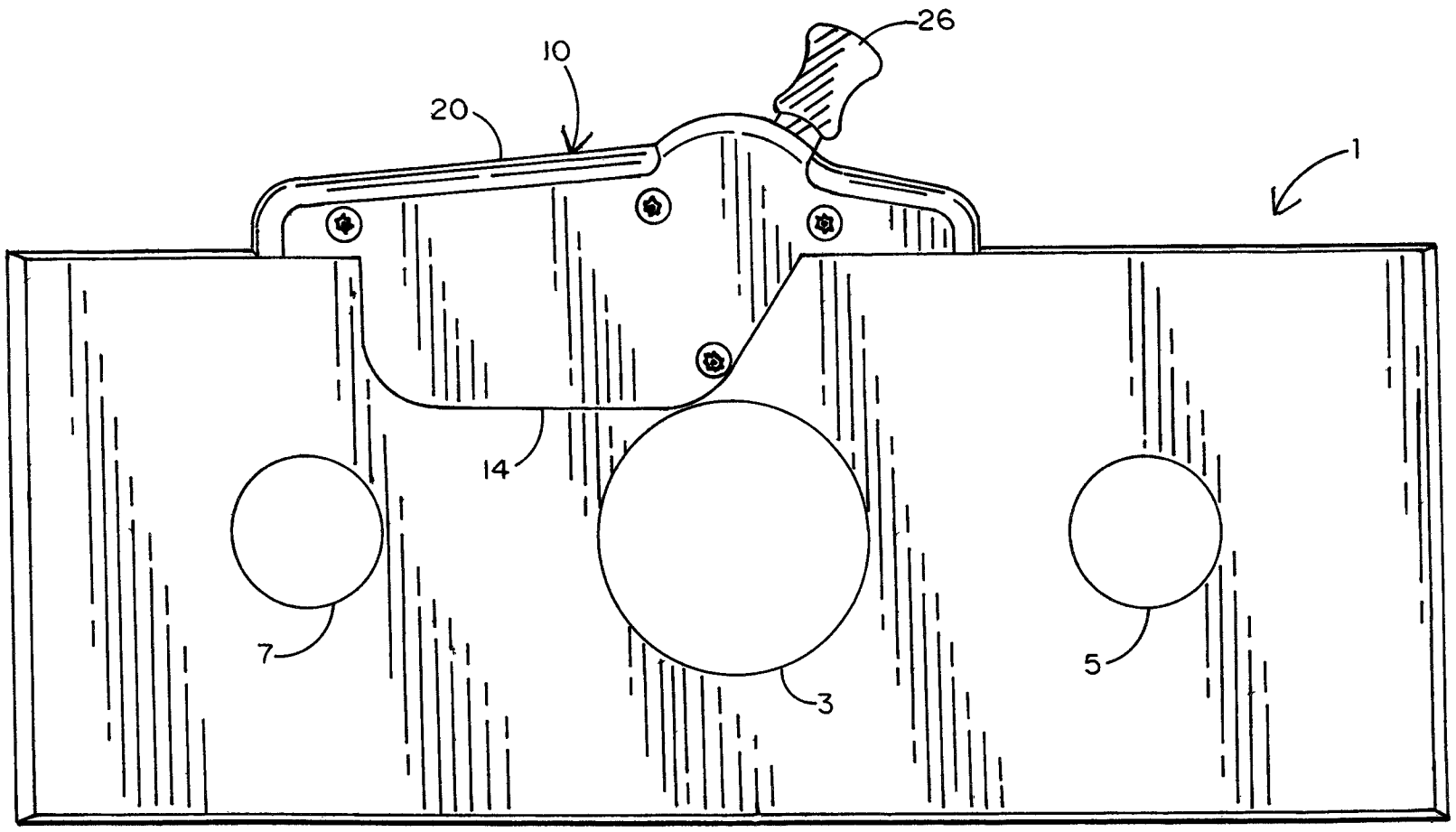
FIG. 2 is a top view of the weight plate of FIG. 1 with the fork carried by the toggle lever switch arm moved to the unlocked position.

Referring concurrently to FIGS. 1-4 of the drawings, there is shown a rectangular weight plate 1. The weight plate 1 has a round center bore hole 3 and a pair of round side bore holes 5 and 7. Each of the center and side bore holes 3, 5 and 7 extends completely through the weight plate 1. The round center bore hole 3 is sized to accommodate a conventional cylindrical center post (designated 50 and best shown in FIGS. 3-6) of the kind used by a typical weight plate lifting exercise apparatus. The round center bore hole 3 expands to a larger elliptical shape 8 at the bottom of weight plate 1 (best shown in FIG. 1). In the case where the weight plate 1 is one of a vertical stack of weight plates located one above the other, the center post 50 extends continuously and axially through the center bore hole formed in each of the weight plates in the stack. The side bore holes 5 and 7 are located at opposite sides of the center bore hole 3 and sized to accommodate respective cylindrical guide rods (not shown) that are common to many weight plate lifting apparatus. As will be understood, the guide rods provide vertical tracks along which one or more of the weight plates from the stack will ride during a weight lifting exercise. Thus, the aforesaid guide rods stabilize and prevent a rotation of a stack of weight plates during the weight lifting exercise.

By way of example, the weight plate 1 has a rectangular body 9 that may be manufactured from iron, steel, urethane, rubber, plastic or composite material. The weight plate body 9 is ideally ten inches long, four inches wide and one inch thick. The weight plate 1 can be manufactured in different (e.g., five and ten pound) weights and configurations. Therefore, the aforementioned materials and dimensions of the weight plate may change and should not be regarded as limitations of this invention.

Detachably connected to one side of the weight plate body 9 is a locking cartridge 10. Suitable fasteners 12 extend through the locking cartridge 10 whereby the cartridge is connected to the weight plate body 9. Locking cartridge 10 is preferably manufactured from ABS plastic or a similar impact-resistant material. By removing the fasteners 12, the locking cartridge 10 can be detached from the weight plate body 9 and repaired or replaced as necessary. However, it is to be understood that the locking cartridge 10 may otherwise be an integral non-detachable part of the weight plate 1 or be manufactured as a single co-extensive part including the weight plate body 9.

A cavity 14 is formed in the side of the weight plate body 9 to which the locking cartridge 10 is connected. The locking cartridge 10 includes a generally hollow housing 18 (best illustrated in FIGS. 3 and 4) that is received inwardly of the cavity 14 formed in the weight plate body 9. A hollow (i.e., evacuated) intermediate channel 16 (also best illustrated in FIGS. 3 and 4) is created within the weight plate body 9 so as to lie between the interior of the hollow housing 18 of cartridge 10 and one side of the round center bore hole 3 through weight plate 1. An elongated top 20 of the locking cartridge 10 extends across the housing 18 thereof. The top 20 of the locking cartridge 10 lies flush against the outside of the weight plate body 9. The fasteners 12 which connect the locking cartridge 10 to the weight plate body 9 run through holes located at opposite ends of the top 20 of cartridge 10 for removable receipt by corresponding holes 22 formed in the weight plate body 9.

The locking cartridge 10 includes a toggle lever switch arm 24 that is located within and rotatable through the hollow housing 18 of cartridge 10. The rotation of the toggle lever switch arm 24 within the housing 18 is controlled by a switch control knob 26. The switch control knob 26 is accessible outside the housing and above the top 20 of cartridge 10. The control knob 26 is connected to a first end 28 of the switch arm 24. The first end 28 projects outside the housing 18 through a guide slot 30 that is formed through the top 20 of the locking cartridge 10. The switch control knob 26 is moved back and forth through guide slot 30 in one of the directions indicated by the reference arrows of FIG. 1 so as to impart a corresponding movement (i.e., rotation) to the switch arm 24 within the housing 18 of cartridge 10.

The first end 28 of the toggle lever switch arm 24 is connected to an opposite end 32 at an elbow 34. The first and opposite ends 28 and 32 of switch arm 24 are aligned with one another at an angle of about 135 degrees with respect to elbow 34. The opposite end 32 of switch arm 24 carries a curved catch or fork 36. The fork 36 carried by the switch arm 24 has a pair of elongated projections or fingers 38 that lie opposite one another and are separated by a space 40. The fingers 38 of fork 36 run alongside one another such that the space 40 therebetween has a generally elliptical configuration which is sized to accommodate the cylindrical center post 50 of the weight lifting apparatus therewithin for a purpose that will soon be described.

A pivot hole 44 (best shown in FIG. 4) is formed through the elbow 34 of the toggle lever switch arm 24 at the intersection of the first and opposite ends 28 and 32 thereof. A pivot pin 46 (best shown in FIG. 3) projects inwardly from one wall of the housing 18 of the locking cartridge 10 to establish a pivot axis around which the switch arm 24 can rotate. The pivot pin 46 is received through the pivot hole 44, whereby the switch arm 24 is pivotally coupled to the pin 46 and adapted to rotate within the housing 18 of locking cartridge 10.

Figure 3:
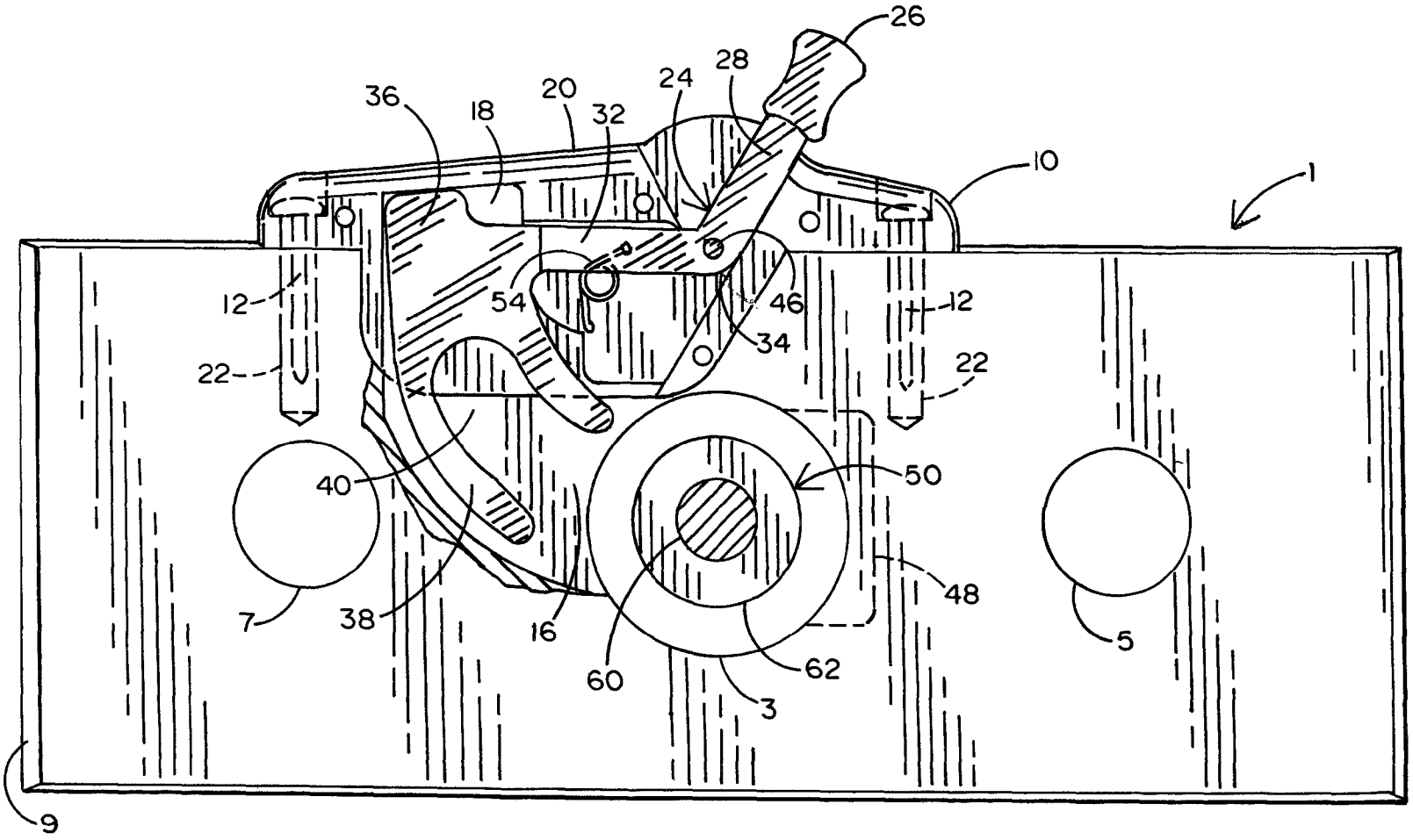
FIG. 3 is a top, partially broken-away view of the weight plate with the fork moved to the unlocked position.

As an important feature of the weight plate 1 of the present invention, a finger locking cavity 48 is formed within the body 9 of weight plate 1. The finger locking cavity 48 is axially aligned and communicates with the intermediate channel 16 of the weight plate body 9 at the opposite side of the center bore hole 3. That is, the intermediate channel 16 runs through the weight plate body 9 to communicate with one side of the center bore hole 3 within which the center post 50 (of FIGS. 3-6) is received, and the finger locking cavity 48 runs through the weight plate body 9 to communicate with the opposite side of center bore hole 3. As is best shown in FIGS. 3 and 4, the finger locking cavity runs in a longitudinal direction within the weight plate body 9 so as to create an extension of the axially-aligned intermediate channel 16.

Accordingly, a rotational force applied by a user to the switch control knob 26 causes a corresponding rotation of the toggle lever switch arm 24 at the pivot pin 46. The switch control knob 26 and the toggle lever switch arm 24 to which the knob 26 is connected are rotatable between an unlocked position shown in FIG. 3 and a locked position shown in FIG. 4. As the control knob 26 is rotated, the first end 28 of the switch arm 24 is rotated through the guide slot 30 at the top 20 of the locking cartridge 10. At the same time, the curved fork 36 carried by the opposite end 32 of the switch arm 24 is rotated within the housing 18 of the locking cartridge 10. The fork 36 travels back and forth through the intermediate channel 16 and the finger locking channel 48 formed in the weight plate body 9 depending upon whether the switch control knob 26 is being rotated to the unlocked or to the locked position.

Figure 4:
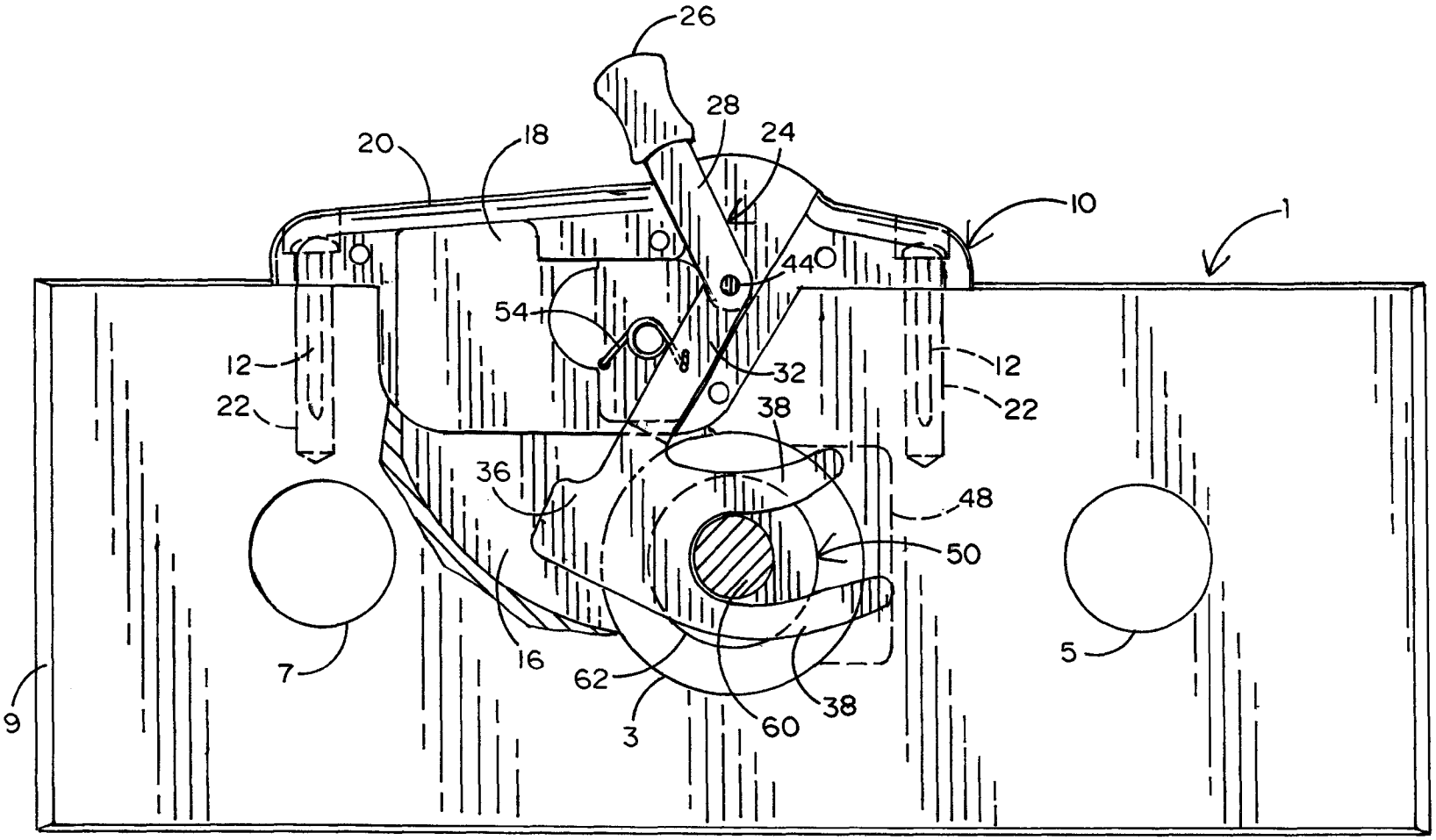
FIG. 4 is a top, partially broken-away view of the weight plate with the fork carried by the toggle lever switch arm moved to the locked position and elongated fingers of the fork received within a finger locking cavity formed in the weight plate and lying adjacent the center bore hole.

In the case where the switch control knob 26 is rotated to the locked position of FIG. 4, the fork 36 is rotated at pivot pin 46 in a first direction through the intermediate channel 16 until the pair of spaced fingers 38 are moved inside and around the center bore hole 3 of the weight plate 1. As will be described in greater detail when referring to FIG. 6, when the switch control knob 26 is rotated to the locked position, the fork 36 is moved into locking engagement with the cylindrical center post (designated 50 in FIG. 6) of the weight lifting apparatus. That is, the center post will be captured within the space 40 between the fingers 38 of the fork 36 so that the weight plate 1 is added to a stack of weight plates already coupled to the center post to increase the total weight to be lifted during an exercise.

As another important feature of the weight plate 1, with the switch control knob 26 rotated to the locked position, each of the pair of fingers 38 of the fork 36 is sufficiently long so as to extend completely through and beyond the center bore hole 3 for receipt within the finger locking cavity 48 which communicates with and lies opposite the intermediate channel 16. By virtue of the receipt of the fingers 38 of the fork 36 within the finger locking cavity 48, the weight plate 1 is provided with a structural reinforcement by which to help prevent the inadvertent detachment of the fork 36 from its locking engagement to the center post 50 after the weight plate 1 has been lifted in response to an upward pulling force applied to the center post by the weight plate lifting exercise apparatus. Accordingly, the heavy weight plate 1 will be reliably coupled to and lifted by the center post 50 throughout the exercise.

In the case where the switch control knob 26 is rotated to the unlocked position of FIG. 3, the fork 36 is rotated around pivot pin 46 in an opposite direction through the intermediate channel 16 such that the pair of elongated fingers 38 of fork 36 are pulled out of the finger locking cavity 48 and away from the center bore hole 3. Thus, the fingers 38 of fork 36 are moved out of their former locking engagement with the center post 50 of the weight lifting apparatus. The weight plate 1 is now uncoupled from the center post so as to no longer be part of the stack of weight plates to be lifted during the exercise in order to reduce the total weight of the lift. It may therefore be appreciated that the user will be able to selectively control the number of weight plates that are coupled to the center post and simultaneously lifted by moving the switch control knob 26 of each of a plurality of weight plates (not shown) to one of the locked or unlocked positions in the manner just explained.

In this same regard, and as is best shown in FIGS. 3 and 4, one end of a torsion (e.g., coil) spring 54 is connected to the toggle lever switch arm 24, and the opposite end of the spring 48 is connected to the housing 18 of the locking cartridge 10 (best shown in FIG. 1). The torsion spring 54 urges the switch arm 24 to automatically rotate towards either one of the unlocked or locked positions so as to avoid an indefinite, intermediate position therebetween.

Figure 5:
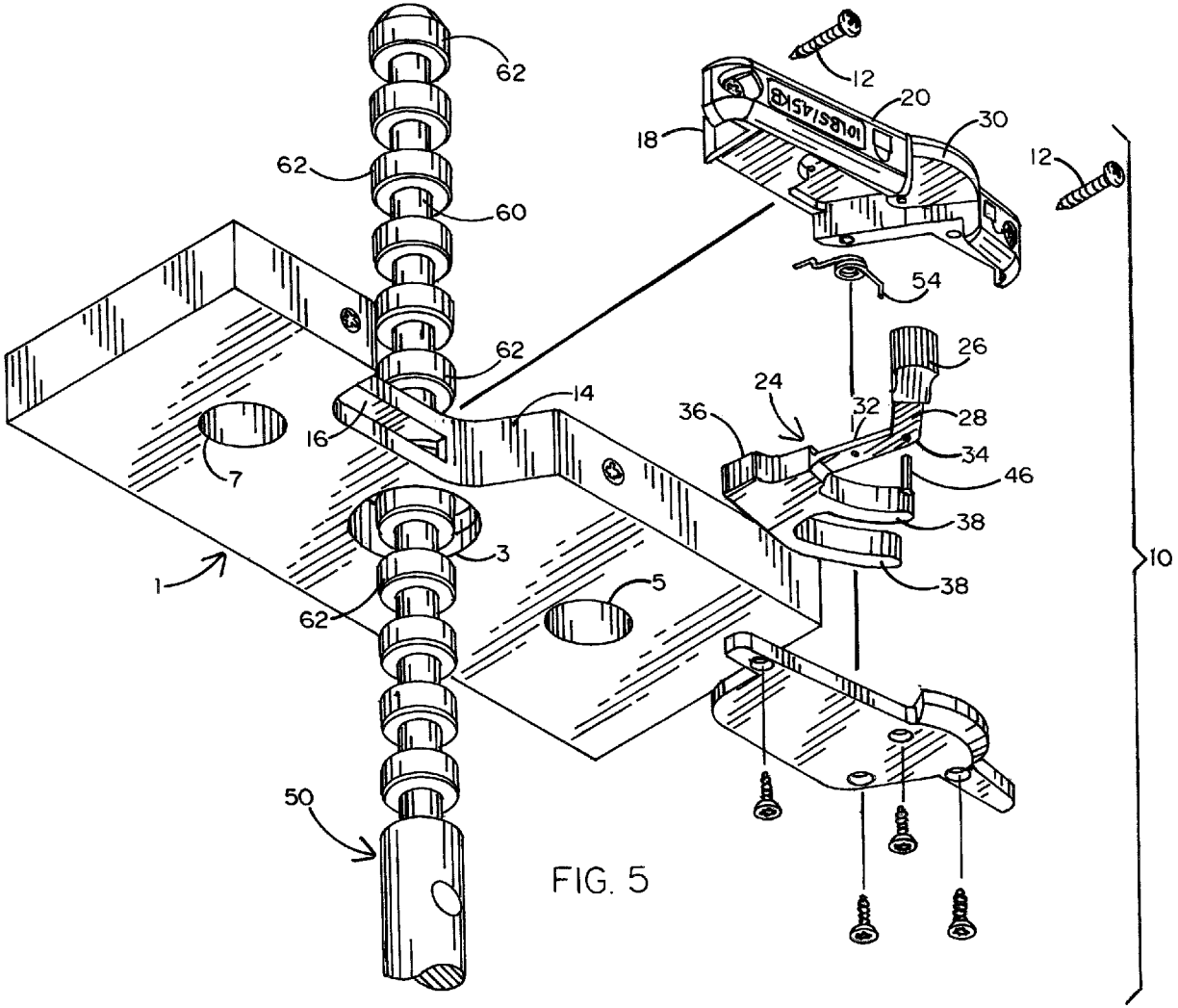
FIG. 5 shows an exploded view of the locking cartridge to be detachably connected to the weight plate and a conventional center post of a weight lifting apparatus received through the center bore hole so that the weight plate can be coupled to the center post.

FIG. 5 of the drawings shows an exploded view of the locking cartridge 10 that, as was previously explained while referring to FIGS. 1-4, is detachably connected to the weight plate body 9. FIG. 5 also shows the cylindrical center post 50 to be coupled to the body 9 of weight plate 1 to transmit a lifting force thereto.

Figure 6:
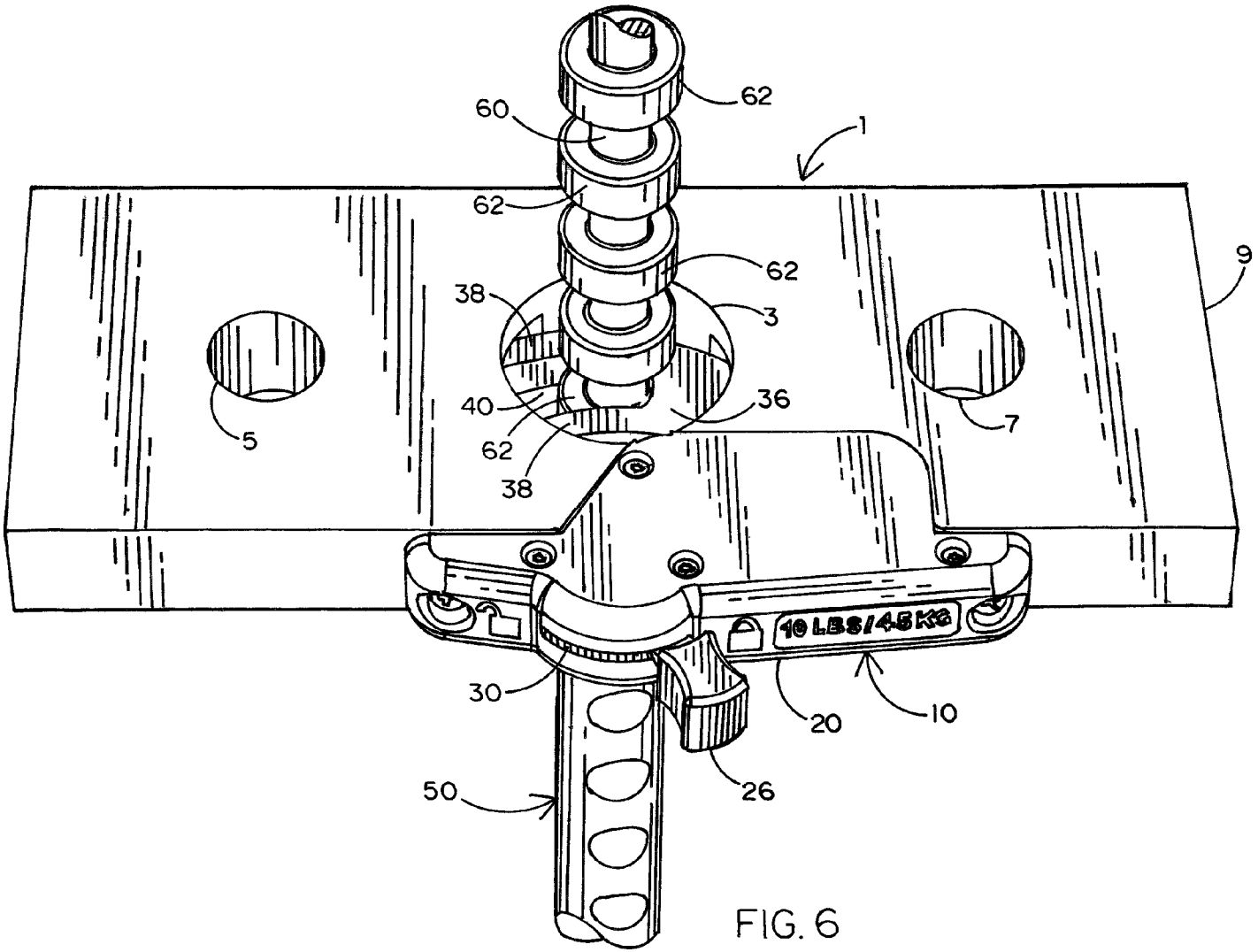
FIG. 6 shows the weight plate with the fork carried by the toggle lever switch arm moved to the locked position, whereby to couple the weight plate to the center post of the weightlifting apparatus.

FIG. 6 of the drawings illustrates the center post 50 coupled to the weight plate 1 in its fully-assembled configuration with the locking cartridge 10 connected to the weight plate body 9. One or more weight plates, such as that designated 1 in FIGS. 1-4, can be selectively coupled to the center post 50 so as to be lifted by a user during a weight lifting exercise. As earlier explained, the center post 50 extends continuously through the center bore hole 3 of each weight plate from a stack of weight plates to be lifted.

The center post 50 includes an elongated cylindrical rod 60 that is surrounded by a plurality of cylindrical stops 62 that are uniformly spaced from one another. The diameter of the stops 62 is larger than the diameter of the rod 60 such that a gap is established between successive pairs of stops 62. FIG. 6 shows the locking cartridge 10 after the switch control knob 26 thereof has been rotated to the locked position so that the weight plate 1 is releasably coupled to center post 50. More particularly, and as was previously described when referring to FIG. 4, moving the switch control knob 26 to the locked position causes the toggle lever switch arm (designated 24 in FIG. 4) to rotate within the housing 18 of locking cartridge 10 until the fork 36 carried by switch arm 24 is correspondingly rotated through the intermediate channel 16 and into the center bore hole 3 of weight plate 1 so as to lie in surrounding locking engagement with the center post 50.

In this case, the relatively narrow rod 60 of the center post 50 between a pair of adjacent relatively wide stops 62 is received within the space 40 between the pair of fingers 38 of the fork 36. The fingers 38 surround and engage the rod 60 between the stops 62, whereby the center post 50 is captured by the fork 36. Accordingly, the weight plate 1 is now coupled to the center post 50 to be lifted with other plates of a stack of weight plates during the weight lifting exercise. At the same time, the elongated fingers 38 of fork 36 extend completely through the center bore hole 3 for receipt within the finger locking cavity 48 of FIG. 4 that lies opposite and communicates with intermediate channel 16 so as to advantageously reinforce the attachment of weight plate 1 to the center post 50. In this same regard, any other weight plates may be selectively coupled to the center post 50 between pairs of adjacent stops 62 by simply rotating the switch control knobs 26 of respective locking cartridges 10 to the locked position like that shown in FIG. 6. As was previously described while referring to FIG. 3, one or more of the other weight plates from the stack can be uncoupled from the center post 50 by simply rotating the switch control knobs 26 to the unlocked position by which the respective forks 36 thereof are uncoupled from their surrounding locking engagement with center post 50.

The invention claimed is:

1. A combination comprising:

a weight plate having a bore hole formed therethrough and a locking cavity lying adjacent a first side of and communicating with said bore hole; and a post received through the bore hole of said weight plate so that said weight plate can be coupled to and lifted by said post, said weight plate also having a switch arm that is movable relative to said weight plate, a first end of said switch arm receiving a force for causing said switch arm to move in either a first direction to an unlocked position at which the weight plate is uncoupled from the post or in an opposite direction to a locked position at which the weight plate is coupled to the post so as to be lifted thereby, the opposite end of said switch arm being sized to move into locking engagement with said post within said bore hole and to extend completely through said bore hole for receipt by said locking cavity adjacent the first side of said bore hole when said switch arm is in said locked position; wherein the opposite end of said switch arm is a fork having opposing first and second fingers and a space lying between said first and second fingers, said first and second fingers extending completely through said bore hole for receipt by said locking cavity such that said post is located within said space between and engaged by said first and second fingers when said switch arm is moved to said locked position.

2. The combination recited in claim 1, wherein said weight plate also has a hollow channel formed therewithin so as to lie adjacent and communicate with a second side of said bore hole, said switch arm moving to said locked position through said hollow channel so that the opposite end of said switch arm is correspondingly moved into said locking engagement with said post and completely through said bore hole for receipt by said locking cavity adjacent the first side of said bore hole.

3. The combination recited in claim 2, said weight plate also having a locking cartridge, said switch arm being rotatable within said locking cartridge and through the hollow channel formed in said weight plate so that the opposite end of said switch arm is correspondingly moved into said locking engagement with said post and completely through said bore hole for receipt by said locking cavity.

4. The combination recited in claim 2, wherein said locking cavity and said hollow channel are axially aligned with one another adjacent the first and second sides of said bore hole.

5. The combination recited in claim 1, wherein said weight plate has a hollow portion, said switch arm extending from inside said hollow portion to the exterior of said weight plate and outside said hollow portion at which the first end of said switch arm receives the force for causing said switch arm to move in one of said first or opposite directions to said unlocked and locked positions.

6. The combination recited in claim 1, wherein said weight plate also has a pivot connected to said switch arm, whereby said switch arm rotates at said pivot between said locked and unlocked positions.

7. The combination recited in claim 6, wherein said pivot is connected to said switch arm between the first and opposite ends thereof.

8. The combination recited in claim 7, wherein the first and opposite ends of said switch arm are angled relative to one another, said pivot connected to said switch arm at the intersection of said first and opposite ends.

9. The combination recited in claim 1, wherein said post has a pair of stops extending therearound and being spaced from one another, the first and second fingers of said fork surrounding and engaging said post between said pair of stops when said post is located within the space between said first and second fingers and said switch arm is moved to the locked position.

10. A weight plate to be coupled to a post of a weight lifting apparatus so that said weight plate can be lifted by said post in response to a lifting force applied thereto, said weight plate comprising:

a bore hole extending through said weight plate in which to receive the post;

a hollow channel communicating with said bore hole at a first side thereof;

a locking cavity communicating with said bore hole at a second side thereof such that said hollow channel and said locking cavity are aligned with one another; and a pivotal switch arm having first and opposite ends and being rotatable through said weight plate, the first end of said pivotal switch arm receiving a force for causing said switch arm to rotate through said hollow channel in either a first direction to an unlocked position at which the weight plate is uncoupled from the post or in an opposite direction to a locked position at which the weight plate is coupled to the post so as to be lifted thereby, the opposite end of said pivotal switch arm being sized to move into locking engagement with said post within said bore hole and to extend completely through said bore hole for receipt by said locking cavity when said pivotal switch arm is in said locked position; wherein the opposite end of said pivotal switch arm is a fork having first and second fingers and a space lying between said first and second fingers, said first and second fingers extending completely through said bore hole for receipt by said locking cavity such that said post is located within the space between and engaged by said first and second fingers when said pivotal switch arm is rotated to said locked position.

11. The weight plate recited in claim 10, wherein the first and second sides of the bore hole extending through said weight plate are positioned opposite one another, such that said hollow channel and said locking cavity lie in opposing axial alignment with one another.

* * * * *